US005152954A

United States Patent [19]

Helmut

[11] Patent Number: 5,152,954

[45] Date of Patent: Oct. 6, 1992

[54] GAS PLUG FOR METALLURGICAL SMELTING CRUCIBLES

[75] Inventor: Preyer Helmut, Kurtscheid. Fed. Rep. of Germany

[73] Assignee: Radex-Heraklith Industriebeteiligungs Aktiengesellschaft, Austria

[21] Appl. No.: 403,653

[22] Filed: Sep. 6, 1989

[30] Foreign Application Priority Data

Sep. 10, 1988 [DE] Fed. Rep. of Germany ..... 3830871

[51] Int. Cl.[5] ..... C21B 7/16

[52] U.S. Cl. ..... 266/270; 266/220

[58] Field of Search ..... 266/218, 220, 265, 266, 266/270

[56] References Cited

U.S. PATENT DOCUMENTS 4,568,066 2/1986 Grabner et al. ..... 266/220
4,695,043 9/1987 Winkelmann et al. ..... 266/218

FOREIGN PATENT DOCUMENTS 0105868 9/1983 European Pat. Off. .
3716920 12/1988 Fed. Rep. of Germany ..... 266/270

*Primary Examiner*—R. Dean
*Attorney, Agent, or Firm*—John F. A. Earley; John F. A. Earley, III

[57] ABSTRACT

The invention concerns a gas plug for metallurgic smelting crucibles with a sheet-metal sheathing that comprises at least the gas connection side part of the outer surface and the bottom, with the exception of an area for connecting the gas supply means.

17 Claims, 1 Drawing Sheet

GAS PLUG FOR METALLURGICAL SMELTING CRUCIBLES

DESCRIPTION

Porous, ceramic gas plugs for injecting treatment gases, particularly inert gases, into metallurgic vessels have been known for a long time. They are subdivided into, among others, plugs with directional and random porosity or joint purging plugs.

The Radex-Rundschau (Review) 1987, 288, has a summary.

On pages 300 and 301, break-out safety systems for gas plugs are described, the details of which stem from the EP-B-105 868.

The invention is based, according to type, on such a gas plug with a rupture proof mechanism.

The known break-out safety system consists of a safety block of fireproof, ceramic material in which one or several gas pipes are arranged in the shape of a spiral. The safety block is bonded firmly to the gas plug positioned on top of it by a fireproof mortar so that the gas stream passing through the gas pipes in the safety block can then flow through the porous, ceramic cleansing unit and pass from there into the molten metal.

The safety function of the known arrangement is due to the fact that in any penetration of molten metal, for example, between the sheet-metal sheathing of the gas plug and the well block or as well between the sheet-metal sheathing and the gas plug or through the plug itself, the smelt is prevented by the safety block from spreading further and that furthermore, any molten metal penetrating into the gas pipe is brought to a stop or solidified by the pipe system. An uncontrollable molten metal efflux is thereby prevented.

The known arrangement has proven effective in practice with regard to its technical function.

Yet is is just as true that breakthroughs of the type mentioned are relatively rare. With the known arrangement, there is thus a certain disadvantage in the fact that after a normal amount of wear, the safety block solidly bonded to the gas plug must be disposed of and replaced with a new system, although the safety block with its gas pipe system actually could still be used. A separation of the two parts is not possible without destruction.

It is thus one object of the invention to develop a porous gas plug of the type described above to the effect that the break-out safety system can be used again if no molten metal has penetrated into the gas pipe and only the actual porous section of the plug must be replaced.

The essential idea of the invention is to arrange the corresponding surfaces of the porous gas plug and of the safety block in a sealing but separable manner using appropriate combining systems.

The gas plug is characterized, in its most general type by the following features:

- a metal sheathing that covers at least that part of the peripheral area next to the gas supply unit and the bottom, with the exception of a connection area for the gas supply line,
- a gas connection nipple provided in the connecting area for the gas supply line, that is solidly connected with the metal sheathing
- a safety block that has, on its end facing the gas plug, a connecting piece for the gas-tight but separable connection with the gas connection nipple, from which a gas pipe with at least one siphon-like or bent shaped section passes through the safety block to an adapter located in distant relationship to the connecting piece in the safety block, and to which an outside gas source can be connected, from which a treatment gas can be sprayed through the adapter, the gas pipe, the connecting piece and the gas connection nipple into the actual gas permeable plug of fireproof, ceramic material and from there into a molten metal.

The gas connection nipple in the gas plug and the connecting piece in the safety block are then primarily responsible, on the one hand, for a safe and plane arrangement of gas plug and safety block, but on the other hand as well, for the ability to separate both parts from each other.

These two parts are aligned to each other in such a way that the safety block can be quickly and easily hooked up to or disconnected from the gas plug, normally situated in a well block, to then, after replacement of the actual gas plug with a new, unused one, be reconnected to this new gas plug.

For a person skilled in the art, there are various possible concrete versions available.

According to a first embodiment, the gas connection nipple and the connecting piece, as well as the gas pipe and the adapter, should be made of metal parts. Metal parts have the advantage that, while extremely solid and sufficiently temperature resistent (the parts are located in the area of the purging system that is away from the molten metal), they are not as brittle as the ceramic components, although the parts mentioned can also be produced from a ceramic material, particularly of an aluminum or zirconium dioxide base.

But above all, certain shaping can be more easily carried out in metal parts and, according to another version of the invention, it is proposed to form gas connection nipple and connecting-piece with corresponding threaded sections.

This can be done, for example, so that the gas connection-nipple projects from the bottom plate of the gas plug towards the safety block (downwards) and has outside threads on this section, while the connecting piece on/in the face of the safety block is formed with corresponding inside threads such that both parts can be easily screwed together, of course, in the formation of a common passageway for the treatment gas.

It is just as possible to have the gas connection nipple protrude inwards into the ceramic material of the gas plug, with the connection nipple then preferably formed with inside threads. Of course, the connecting-piece then protrudes accordingly beyond the corresponding contact surface of the safety lock and has corresponding outside threads.

As already described, the gas connection nipple is preferably solidly bonded to the bottom plate of the gas plug, for example welded. For stability reasons, it is recommended to form the bottom plate somewhat thicker than usual for this purpose, since it must now have sufficient mechanical durability in addition to being gas tight, in order to firmly hold the safety block fastened to it.

According to an alternative version, the gas connection nipple and connecting piece are formed in the formation of a common slide-type spring lock (quarter turn fastener), i.e., the threaded connection is replaced with a bayonet type locking system.

In order to guarantee a precise gas plug and safety block positioning height-wise, it is advantageous to provide one or more impact points between gas plug and safety block, that are preferably formed in the area of the gas connection nipple or connection piece. In this way, it can be assured that the safety block does not get pressed too hard against the gas plug and possibly damages it.

In order to be able to better balance certain tolerances of finishing technology, the invention also proposes the arranging of a thin, elastic, intermediate layer between safety block and gas plug, consisting preferably of a fireproof, ceramic fiber mat that is glued to the underside of the bottom of the sheet-metal cover for example.

In order to prevent undesired gas escape in the area of the connecting components of gas connection nipple and connecting-piece, beyond it at least one more seal can be provided between the two, positioned against on the step formed in the gas connection nipple or connection piece according to one advantageous embodiment of the invention, and consisting of a copper gasket, for example.

The gas pipe, that at one end leads into the connection piece, is preferably arranged below the connection component to the gas plug at that point and runs roughly at right angles to the center axis of the connection piece and is connected gastight with the latter. In this way, a sort of reinforcement is provided for the connection piece at the same time that is imbedded at least partially in the fireproof, ceramic matrix material of the safety block.

In order to reduce the volume of the quantity of penetrating steel and to increase the cooling surface for the quick solidification of the penetrated steel in the case of penetration by molten metal, it is preferred to provide at least two gas pipes in the safety block instead of one gas pipe, preferably ending diametrically opposite the connection piece.

To further raise the surface and make it more difficult for molten metal to penetrate, the gas pipes are spiral-shaped or siphon-like, but with at least several bends and intermediary sections before they open, in distant relationship to the connection piece, into the already mentioned adapter, which can be brought into contact with an external gas source.

This adapter is preferably positioned opposite the connection piece in the area of the lower face of the safety block.

To be able to better handle the safety block, i.e., to be able to fix it to the gas plug quickly and easily, an advantageous version of the invention has the safety block developed with an operating mechanism through which the safety block can be moved manually or using a tool.

A particularly simple version has at least two metal arms, arranged at a distance from each other and attached in the safety block, projecting outwards over the lower face of the safety block, with the projecting area able to be easily clasped by a tool for subsequent manipulating when setting it on the gas plug.

Further features of the invention result from the features of the sub-claims as well as the other registration documents.

The bottom plate of the gas plug can thus lay directly against the ceramic matrix mass, but it is just as feasible to arrange a recess (gas distributing chamber) between the bottom of the sheet-metal cover and the bottom of the porous, ceramic body using corresponding range spacer. In this way, the gas quantity flushed in through the gas connection nipple can be favorably distributed over the entire surface of the gas plug.

Besides the advantages mentioned of the reusability of the safety block by a separable connection at the gas plug, the construction of the gas plug according to the invention offers another essential advantage.

Normally, a regular gas plug (without break-through safety system) is pulled out of the wall or the bottom of the metallurgic smelting crucible on replacement using a so-called extracting device. Such a device and the process associated with it are described in the EP-B-137 961, for example. For this, a coupling cylinder that projects over the gas connection nipple is to be placed around the gas connection nipple, and to which the extracting device is then attached.

In a gas plug construction according to the invention, this expense can be reduced because, for example, the outside threads on the gas connection nipple or the quarter-turn fastener can be used directly for adapting a corresponding extracting tool. The gas connection nipple thereby fulfills a dual function and the construction expense on the actual gas plug can thus be additionally reduced and the repair procedure simplified.

The invention is described in more detail in the following using a model sample that shows, in diagram form.

When the term "gas plug" is used in this application, this is in a dual sense, i.e., to identify the "actual" gas plug identified subsequently with the reference number 10 and describing the gas plug formed with directed or random porosity or as joint purging plug and on the other hand, also as identification of the whole of gas plug 10 and break-out safety system which, after being mounted on the gas plug 10 is practically speaking an integral component of the gas purging system.

Figure 1:
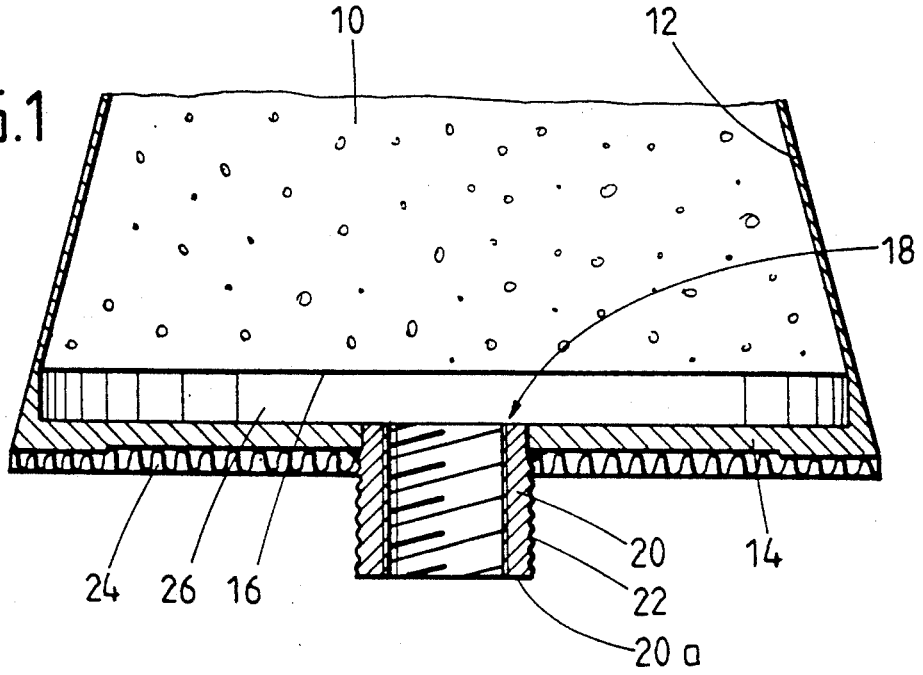
FIG. 1: the lower part of a gas plug with a gas connection nipple.

The gas plug 10 according to FIG. 1 is one with directional porosity, with the individiual gas canals not illustrated.

The gas plug 10 is surrounded by a sheet metal cover 12 (mortared onto it) at its lower part shown in FIG. 1, with the sheet-metal cover 12 running on the underside into a bottom plate 14 that displays a clearly greater material thickness than the circumferential sheet-metal cover 12. The lower face 16 of the gas plug 10 is situated at a distance from the bottom plate 14, which is achieved using corresponding (not shown) vertical range spacer (spreaders).

In the middle, the bottom plate 14 has an opening 18 and, in this area, a gas connection nipple 20 is welded to the bottom plate 14. The metal gas connection nipple 20 has, in its section below the bottom plate 14, outside threads 22 in the form of movement threads with a round or trapezoid profile.

On the under side of the bottom plate 14, a fireproof, ceramic fiber mat 24 is adhered around the gas connection nipple 20.

Figure 2:
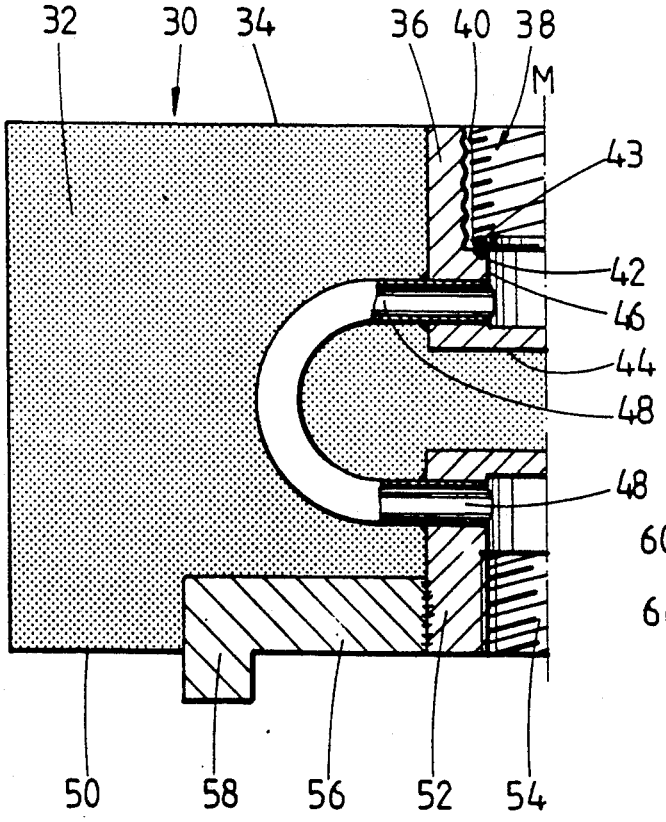
FIG. 2: a longitudinal cross-section through a part of a safety block, according to the invention, and in FIG. 3: an extraction tool for the gas plug according to FIG. 1

In FIG. 2, in simplified form, the left half of a safety block 30 is illustrated, the right half of which is constructed homologously to the illustrated one.

The safety block 30 has a cylindrical shape and consists of a fireproof, inorganic matrix material 32, ceramic or concrete, for example.

Concentric to the central longitudinal axis M, a metal connection piece 36 extends from the upper face 34 of the safety block into the inside of the safety block. The connection piece 36 is essentially jar-shaped and the upper section of the inner surface 38 is formed with inside threads 40 that correspond to the outside threads 22 of the gas connection nipple. At the lower end of the inside threads 40, the inner surface 38 of the connection piece 36 projects inward as a step (42) and extends from there cylinder-shaped towards the bottom 44 of the connection piece 36.

A ring-shaped copper gasket 43 in conformance with DIN (German Industrial Norm) 7603 rests on step 42.

Two copper gas-pipes 48 (one to the left and one to the right in the plane in the drawing) extend from the lower cylinder-shaped section 46, with the gas pipes each welded to the connection piece 36.

An adapter 52 extends inward from the lower face 50 of the safety block 30, similarly to the connection piece 36, into the matrix material 32, with the adapter 52 also jar-shaped with a cylindrical opening 54 in the middle that is open at the bottom.

The gas pipes 48 then run homologously from the connection piece 36 to the adapter 52, with only the connection areas of each shown for greater clarity. In between, the gas pipes 48 can extend practically in any direction, at any rate they have, however, at least one bent section, which is preferably spiral-shaped or siphon-like, as represented and described in the Radex-Rundschau (Review) (or in EP-B-137 968). In this way the device obtains its safety function for the occasion of molten metal penetration which then solidifies quickly due to the threaded sections.

The connection area of the gas pipes 48 then, at the same time, acts as reinforcement for a secure seat of the connection piece 36 or adapter 52 in the matrix material.

Also from the lower part of FIG. 2, it can be seen that two metal arms 56 extend out from each side of the adapter 52, first running parallel to the lower face 50 of the safety block 30 and then protrude on an angle for a distance from the adapter 52 downwards beyond the lower face 50. The metal arms 56 are welded onto the adapter 52.

The gas plug or the gas plug system according to the invention is put together as follows. First, the porous plug is positioned in the familiar manner in a well block in the bottom of a metallurgic smelting crucible, for example. Then, the safety block 30 is screwed onto the gas connection nipple 20 of the gas plug 10 by means of the connection piece 36. This is performed with a tool that is clamped onto the downward extending sections 58 of the metal arms 56.

In the final phase, the upperface 34 of the safety block 30 presses against the fiber mat 24 and compresses it until the lower face 20*a* of the gas connection nipple 20 presses against the step 42 or the gasket 43 resting on it. At this point in time, the safety block 30 has reached its final position next to the gas plug 10 and both are firmly connected to each other. As an alternative, the joining of the gas plug and the safety block could also take place prior to a common assembly.

For gas purging, an outside gas source can now be connected to the adapter 52 and the gas then flows through the gas pipes 48 via the connecting-piece 36 through the gas connection nipple 20 into the gas distribution chamber 26 and then finally through the (not shown) supply canals in the gas plug 10 into the metallurgic smelting bath.

Figure 3:
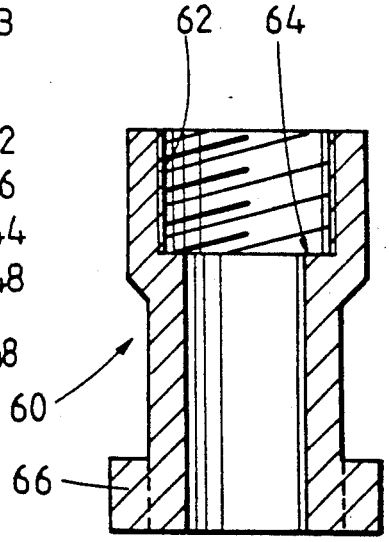

If the gas plug 10 is worn, without any penetration of molten metal into the plug having taken place yet, first, with a tool the safety block 30 is screwed back off and removed, in the opposite way to the mounting described earlier. Then the essentially cylinder-shaped accessory tool 60 shown in FIG. 3, is screwed onto the gas connection nipple 20. The tool 60 is shaped in its upper part analogous to the section of the connection piece 36 for this purpose, i.e., with inside threads 62 and a step 64. If the tool 60 is firmly screwed on, a suitable extracting device is arranged around the gas plug 10 and this extraction device then clamps the lateral arms 66 in the lower section of the tool 60 and by means of a suitable pulling device, the gas plug 10 is pulled out of the well block or the bottom or the wall of the metallurgic smelting crucible by means of the tool 60.

The gas connection nipple 20 thus serves not only the purpose of a gas supply pipe, but is also used as an intermediate piece in the placement of a tool for the extracting device.

Now, a new gas plug is employed in the known manner and the previously removed rupture-proof means (the safety block 30) is remounted in the described manner.

It is obvious that the safety block 30, in the configuration according to the invention, can be used a number of times and only need be disposed of if a molten metal break-through has occurred and molten metal has penetrated into the connecting piece 36 or the gas pipes 48 and has solidified there.

I claim:

1. Gas plug for metallurgic smelting crucibles with a metal sheathing (12, 14) that covers at least that part of the peripheral area and the bottom next to a gas supplying nipple of the gas plug, with the exception of a connecting area for said gas supplying nipple, said gas supplying nipple being tightly connected to the metal sheathing (12, 14), a safety block (30) that has at its end facing the gas plug (10), a connection piece (36) for a gas-tight yet separable connection with the gas supplying nipple (20), connecting-disconnecting means for connecting the gas supplying nipple to the connection piece to connect the gas plug to the safety block and for detaching the gas supplying nipple from the connection piece when desired so that the safety block may be disconnected from the gas plug when the gas plug is damaged, a gas pipe (48) with at least one siphon-like or bent shaped section passes through the safety block (30) from the connection piece (36) to an adapter (52) located in a distance to the connecting piece (36) in the safety block (30), and to which an outside gas source can be connected, from which a treatment gas can be jetted through the adapter (52), the gas pipe(s) (48), the connecting piece (36) and the gas supplying nipple (20) into the actual gas permeable plug (10) of fireproof, ceramic material and from there into a molten metal.

2. Gas plug according to claim 1, in which the gas supplying nipple (20), the supplying piece (36), the gas pipe(s) (48) and the adapter (52) are made of metal.

3. Gas plug according to claim 1, in which the gas supplying nipple (20) and the supplying piece (36) are formed with corresponding threaded sections (22, 40).

4. Gas plug according to claim 3, in which the gas supplying nipple (20) projects from the bottom plate (14) of the gas plug (10) towards the safety block (30) and has outside threads (22) on this section, functioning in combination with corresponding inside threads (40) of the connection piece (36), being inserted into the face (34) of the safety block (30).

5. Gas plug according to claim 1, in which the gas supplying nipple (20) and the supplying piece (36) is constructed in the form of a quarter turn fastener.

6. Gas plug according to claim 4, in which the inside threads (40) of the connection piece (36) extend from the face (34) downwardly for a partial portion of the total height of the connection piece (36) and the connection piece (36) at the lower end is made with an inward protruding step (42).

7. Gas plug according to claim 6, in which the gas pipe(s) (48) opens (open) out below the step (42) into the connection piece (36).

8. Gas plug according to claim 6, in which a gasket is placed in the area of the step (42).

9. Gas plug according to claim 1, in which the gas pipe(s) (48) passes (pass) siphon-like or spiral-shaped into the safety block (30).

10. Gas plug according to claim 1, in which the gas pipe(s) (48) is (are) made of copper.

11. Gas plug according to claim 1, in which the adapter (52) is positioned on the side of the safety block (30) away from gas plug (10).

12. Gas plug according to claim 1, in which the safety block (30) is provided with an operating device (56, 58) for setting the safety block (30) against the gas plug (10).

13. Gas plug according to claim 12, in which the control device (56, 58) comprises at least two metal arms arranged at a distance from each other, being imbedded in the safety block (30) and projecting outwardly from the matrix material of the safety block (30).

14. Gas plug according to claim 1, in which an elastic intermediate layer (24) is adhered to the lower face of the bottom plate (14) or on the upper face (34) of the safety block (30) leaving open the gas supplying nipple (20) or supplying piece (36) area.

15. Gas plug according to claim 14, in which the elastic intermediate layer (24) comprises a fireproof, ceramic fiber mat.

16. Gas plug for metallurgic smelting crucibles comprising a metal sheathing (12, 14) that covers at least that part of the peripheral area and the bottom next to a gas supplying nipple of the gas plug, with the exception of a connecting area for said gas supplying nipple, said gas supplying means being tightly connected to the metal sheathing (12, 14), a safety block (30) that has at its end facing the gas plug (10), a connection piece (36) for a gas-tight yet separable connection with the gas supplying nipple (20), connecting-disconnecting means for connecting gas supplying nipple to the connection piece to connect the gas plug to the safety block and for detaching the gas supplying nipple from the connection piece when desired so that the safety block may be disconnected from the gas plug when the gas plug is damaged, a gas pipe (48) with at least one bent shaped section passes through the safety block (30) from the connection piece (36) to an adapter (52) located a distance from the connecting piece (36) in the safety block (30), and to which an outside gas source can be connected, from which a treatment gas can be jetted through the adapter (52), the gas pipe(s) (48), the connecting piece (36) and the gas supplying nipple (20) into the actual gas permeable plug (10) of fireproof, ceramic material and from there into a molten metal, the gas supplying nipple (20), the connection piece (36), the gas pipe (48) and the adapter (52) being made of metal, the gas supplying nipple (20) and the connection piece (36) being formed with corresponding threaded sections (22, 40), the gas supplying nipple (20) projecting from the bottom plate (14) of the gas plug (10) towards the safety block (30) and having outside threads (22) on this section, functioning in combination with corresponding inside threads (40) of the connection piece (36), being inserted into the face (34) of the safety block (30), the inside threads (40) of the connection piece (36) extending from the face (34) downwardly for a partial portion of the total height of connection piece (36) and the connection piece (36) at the lower end being made with an inward protruding step (42), the gas pipe (48) opening out below the step (42) into the connection piece (36), a gasket located in the area of the step (42), the gas pipe (48) passing spiral-shaped into the safety block (30), the gas pipe (48) being made of copper, the adapter (52) being positioned on the side of the safety block (30) away from gas plug (10), the safety block (30) being provided with an operating device (56, 58) for setting the safety block (30) against the gas plug (10), the operating device (56, 58) comprising at least two metal arms arranged at a distance from each other, being imbedded in the safety block (30) and projecting outwardly from the matrix material of the safety lock (30), an elastic intermediate layer (24) being adhered to the lower face of the bottom plate (14) or on the upper face (34) of the safety block (30) leaving open the gas supplying nipple (20) or connection piece (36) area, and the elastic intermediate layer (24) comprising a fireproof, ceramic fiber mat.

17. Gas plug apparatus for metallurgic smelting crucibles comprising a gas plug having an upper end portion and a lower end portion, a metal sheathing covering the lower end portion of the gas plug, a gas supplying nipple connected to the metal sheathing for supplying gas to the gas plug, a safety block, a connection piece mounted on the safety block, connecting-disconnecting means for connecting the gas supplying nipple to the connection piece to connect the gas plug to the safety block and for detaching the gas supplying nipple from the connection piece when desired so that the safety block may be disconnected from the gas plug when the gas plug is damaged, a gas pipe through the safety block and having a gas emitting end at the connection piece and a gas admitting end, said gas pipe having at least one siphon-like or bent-shaped section, an adapter mounted on the safety block at the gas admitting end of the gas pipe to which an outside gas source may be connected so that treatment gas may be jetted through the adapter, the gas pipe, the connection piece, and the gas supplying nipple into the gas plug, and from there into a molten metal.

* * * * *